United States Patent [19]

Perretta

[11] 4,082,141

[45] Apr. 4, 1978

[54] BALLAST VIBRATION ISOLATION SYSTEM WITH THERMAL PATH

[75] Inventor: Michael L. Perretta, Manlius, N.Y.

[73] Assignee: Crouse-Hinds Company, Syracuse, N.Y.

[21] Appl. No.: 658,962

[22] Filed: Feb. 18, 1976

[51] Int. Cl.[2] ..... F28F 7/00; H01F 27/08

[52] U.S. Cl. ..... 165/69; 248/358 R; 336/61; 336/65; 336/100

[58] Field of Search ..... 165/69; 248/350, 358 R, 248/21; 336/61, 65, 100, 92

[56] References Cited

U.S. PATENT DOCUMENTS

| | | | |
|---|---|---|---|
| 531,005 | 12/1894 | Priestly | 336/92 |
| 1,885,443 | 11/1932 | Holt | 248/21 |
| 2,770,785 | 11/1956 | Haagens | 336/61 |
| 2,780,787 | 2/1957 | Somerville | 336/61 |
| 2,805,275 | 9/1957 | Bussing | 174/52 |
| 3,218,101 | 11/1965 | Adams | 248/358 R |
| 3,268,199 | 8/1966 | Kordyban | 248/21 |
| 3,323,764 | 6/1967 | Johnson | 248/21 |
| 3,809,427 | 5/1974 | Bennett | 248/358 R |
| 3,883,101 | 5/1975 | Vernier | 248/21 |
| 3,883,834 | 5/1975 | Osteen | 336/61 |
| 3,970,272 | 7/1976 | Kaesgen | 248/358 R |

*Primary Examiner*—Ronald H. Lazarus
*Assistant Examiner*—Daniel J. O'Connor
*Attorney, Agent, or Firm*—Sughrue, Rothwell, Mion, Zinn and Macpeak

[57] ABSTRACT

A ballast can be mechanically and thermally isolated from the mounting plate which acts as a heat sink by securing a pair of L-shaped channels to the bottom of the ballast with the depending leg of each channel being disposed in intimate sliding engagement with the flat surface of a respective C-shaped channel member which is secured to the mounting plate. Vibration damping washers are disposed between the L-shaped channel member and the C-shaped channel member to prevent vibrations from being transmitted from the ballast to the base while still permitting heat dissipation through the superimposed sliding surfaces of the channels.

3 Claims, 2 Drawing Figures

BALLAST VIBRATION ISOLATION SYSTEM WITH THERMAL PATH

BACKGROUND OF THE INVENTION

1. Field of the Invention

The present invention is directed to a vibration isolation system for a ballast and more specifically to a vibration isolation system having a thermal path for the dissipation of heat.

2. Prior Art

When a ballast is mechanically isolated by the use of elastomeric vibration isolators or pads a secondary problem of heat dissipation arises. Not only is the ballast mechanically isolated but it is also thermally isolated from the mounting plate which is supposed to act as a heat sink. It is therefore necessary to supplement the isolating system with a thermal path so that excess heat can be conducted from the ballast to the mounting plate to which it is secured and hence to other members of the fixture.

Attempts have been made in the past to solve this problem by directly supporting the ballast on the mounting plate by means of metallic springs or by completely surrounding and supporting the ballast in spaced relation to a housing by a mass of crumpled or creased metal foil. In both of these solutions a metallic material acts both as the thermal path as well as the vibration isolating means.

SUMMARY OF THE INVENTION

The ballast vibration isolation system according to the present invention utilizes highly efficient elastomeric pads to achieve the vibration damping while still providing a metal to metal parallel thermal path between the ballast and mounting plate.

The ballast vibration isolation system according to the present invention is comprised of a pair of L-shaped metallic channels secured to the bottom of a ballast parallel to each other. A pair of C-shaped metallic channels are secured on their sides to the mounting plate in parallel relation to each other. The vertically disposed leg of each L-shaped channel is disposed in close intimate contact with the flat vertically disposed surface of each channel member with elastomeric pads being disposed between opposed horizontal surfaces of said L-shaped bracket and said C-shaped channel. A thermally conductive grease can be used between the mating surfaces of the L-shaped section and the channel section.

The foregoing and other objects, features and advantages of the invention will be apparent from the following more particular description of a preferred embodiment of the invention as illustrated in the accompanying drawings.

DETAILED DESCRIPTION OF THE PREFERRED EMBODIMENTS

Figure 1:
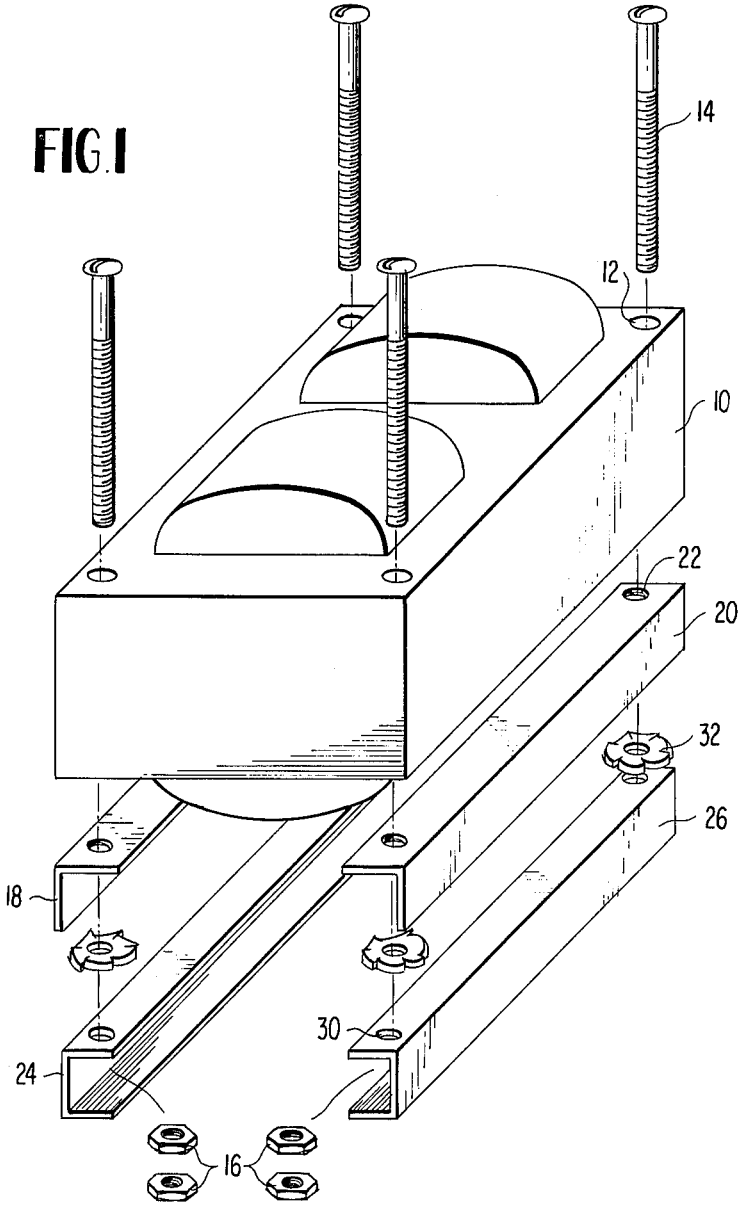
FIG. 1 is an exploded perspective view of the ballast vibration isolation system according to the present invention.

The ballast 10 is of conventional construction and the details thereof do not form a part of the present application. The ballast is provided with a through-hole 12 at each corner for the reception of an elongated threaded bolt 14 which is adapted to extend below the bottom of the ballast a sufficient distance to allow the securement of the mounting brackets thereon by means of a pair of jam nuts 16 or a single locknut.

A pair of L-shaped metallic sections 18 and 20 are each provided with threaded apertures 22 in one leg thereof which are in alignment with the apertures 12 in the ballast for threaded engagement on the bolts 14. If the sections 18 and 20 are secured to the ballast by any other means such as brazing, etc., the apertures 22 would not have to be threaded. A pair of C-shaped channel sections 24 and 26 are disposed in parallel alignment with the L-shaped sections 18 and 20, respectively. The C-shaped channel sections are secured on their sides to a mounting plate 28 by any suitable means such as nuts and bolts, brazing, adhesives or the like. The uppermost leg of each C-shaped channel section is provided with a pair of apertures 30 which are disposed in alignment with the apertures 12 in the ballast and the apertures 22 in the L-shaped sections for the through passage of the bolts 14 with sufficient clearance to allow for lateral movement of each bolt in its respective aperture 30. Finally, four elastomeric washers or pads 32 are provided for assembly on the bolts 14 between the apertured surfaces of the L-shaped sections 18 and 20 and the C-shaped channel sections 24 and 26.

In the assembled condition the bolts 14 pass in sequence through the ballast 10, the apertures 22 in the L-shaped channel sections 18 and 20, the elastomeric washers 32 and the apertures 30 in the C-shaped channel sections 24 and 26. Due to the threaded connection between the bolts 14 and apertures 22 the L-shaped sections 18 and 20 are securely fixed to the ballast. The nuts 16 are secured to the bolts 14 to hold the assembly together with the flat vertically disposed surfaces of the L-shaped sections 18 and 20 being disposed in intimate contact with the flat vertically disposd surfaces of the C-shaped channel sections 24 and 26, respectively. The nuts 16 are tightened sufficiently so that the washers 32 will be firmly but not rigidly engaged by the opposed sections to allow relative movement between sections 18 and 20 and sections 24 and 26, respectively. A thermally conductive grease of any suitable well known type may be disposed between the flat contacting surfaces of the L-shaped sections and the C-shaped channel sections to enhance the thermal conductivity of the assembly.

During the operation of the ballast all of the attendant vibrations will be completely absorbed by the elastomeric washers 32 while the flat contacting surfaces of the L-shaped sections and the C-shaped channel sections provide an efficient and highly effective thermal path between the ballast 10 and the mounting plate 28 for the dissipation of heat. The flat surfaces of the L-shaped sections and the C-shaped channel sections merely slide over each other so that the vibrations of the ballast are not transmitted to the mounting plate.

The L-shaped sections 18 and 20 and the C-shaped channel sections 24 and 26 may be made of any suitable heat conductive metallic material and may be fabricated in any suitable manner. According to the present invention it was found that the extruded aluminum sections were easy to fabricate and also provide for efficient heat transfer. The elastomeric washers 32 may be of any suitable well known material such as synthetic plastics, rubber or the like.

The undesirable vibrations take place in a direction substantially perpendicular to the mounting surface 28.

Figure 2:
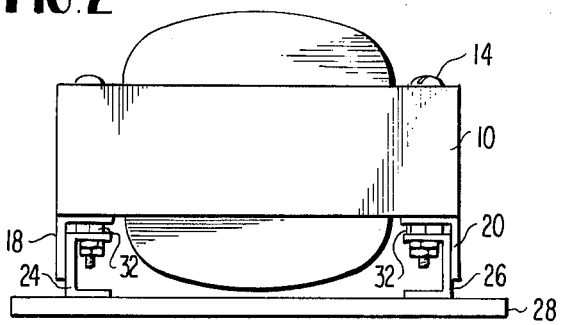
FIG. 2 is an end elevation view of the parts shown in FIG. 1 in assembled condition on a mounting plate.

Therefore, the heat transfer surfaces are disposed in a sliding mode parallel to the direction of vibration. In actual practice the system described above is effective when the mounting plate 28 is disposed in a horizontal plane as shown in FIG. 2 or in a vertical plane. However, if the plate 28 is disposed in a vertical plane the L-shaped sections 18 and 20 and the C-shaped channel sections 24 and 26 should also be disposed vertically to achieve the maximum effectiveness of the vibration damping by the elastomeric washers 32.

While the invention has been particularly shown and described with reference to a preferred embodiment thereof it will be understood by those in the art that various changes in form and details may be made therein without departing from the spirit and scope of the invention.

What is claimed is:

1. A ballast vibration isolation system having a thermal path comprising ballast means, mounting plate means, first heat transfer means secured to said ballast and having at least one flat surface extending outwardly at right angles thereto, second heat transfer means secured to said mounting plate means and having at least one flat surface extending outwardly therefrom at right angles, means securing said first and second heat transfer means together with said flat surfaces being disposed in intimate sliding contact with each other to provide a thermal path between said ballast means and said mounting plate means and vibration isolation means disposed between said ballast means and said mounting plate means.

2. A system as set forth in claim 1 wherein said first heat transfer means is comprised of a pair of L-shaped metallic sections, said second heat transfer means is comprised of a pair of parallel C-shaped channel members and said vibration isolation means is comprised of a plurality of elastomeric washers disposed between said L-shaped sections and said C-shaped channel sections.

3. The system as set forth in claim 2 wherein said sections are aluminum extrusions.

* * * * *